United States Patent [19]

Woodland

[11] 3,930,512

[45] Jan. 6, 1976

[54] COIN SORTING AND COUNTING APPARATUS

[76] Inventor: Jack H. Woodland, 2108 Maple St., Wantagh, N.Y. 11793

[22] Filed: Jan. 21, 1975

[21] Appl. No.: 542,746

[52] U.S. Cl. ..... 133/3 D; 133/8 R

[51] Int. Cl.[2] ..... G07D 3/00

[58] Field of Search ..... 133/3 R, 3 H, 8 R, 3 A–3 D

[56] References Cited

UNITED STATES PATENTS

| | | | |
|---|---|---|---|
| 3,048,251 | 8/1962 | Bower | 133/3 X |
| 3,086,536 | 4/1963 | Klapp | 133/8 R |
| 3,680,566 | 8/1972 | Tanaka | 133 3 R |

*Primary Examiner*—Allen N. Knowles
*Attorney, Agent, or Firm*—Bauer, Amer & King

[57] ABSTRACT

An improved coin sorting and counting apparatus is disclosed. A rotary hopper feeds the coins one at a time to a downwardly inclined track assembly wherein sensing means detect the presence and determine the denomination of the coins as they move therepast. A signal is generated which is proportional to the denomination of each coin and then the signals are totaled.

The foregoing Abstract is neither intended to define the invention of the Application which, of course, is measured by the claims, nor is it intended to be limiting as to the scope of the invention in any way.

10 Claims, 7 Drawing Figures

COIN SORTING AND COUNTING APPARATUS

BACKGROUND OF THE INVENTION

This invention relates generally to coin receiving devices and more particularly to apparatus for sorting and counting coins of different denominations and for operating a toll booth mechanism upon the payment of the correct amount.

It is an object of the present invention to provide an improved coin counting apparatus.

It is another object of the present invention to provide an improved coin counting apparatus for use in conjunction with a toll booth.

A further object of the present invention is to provide an improved apparatus that can accurately count and total randomly inserted coins such as nickels, dimes, quarters, half-dollars and silver dollars.

These and other objects, features and advantages of the invention will, in part, be pointed out in particularity, and will, in part, become obvious from the following more detailed description of the invention, taken in conjunction with the accompanying drawing, which forms an integral part thereof.

BRIEF DESCRIPTION OF THE DRAWING

In the various figures of the drawing, like reference characters designate like parts.

In the drawing.

DESCRIPTION OF THE INVENTION

Figure 1:
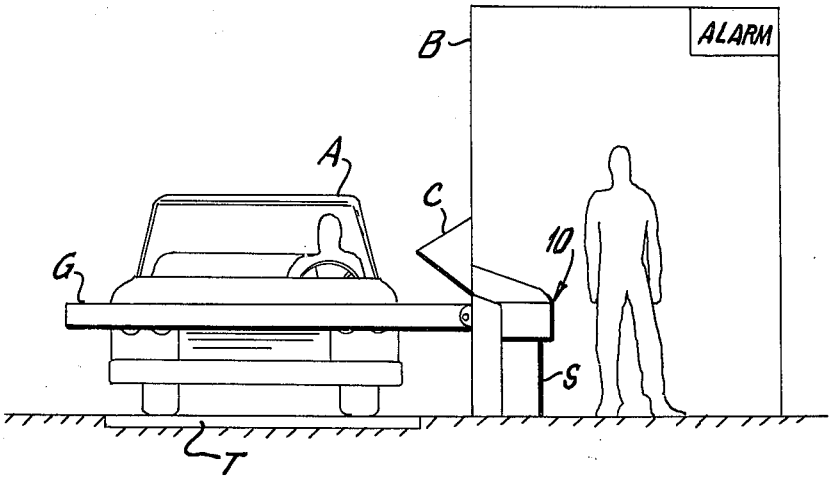
FIG. 1 is a schematic elevational view illustrating an automobile positioned on a treadle adjacent a toll booth collecting station.

As may be seen in FIG. 1, the present invention is used in conjunction with a toll booth B. As automobile A approaches the booth B it rides over a treadle T which is adjacent thereto. The driver then deposits the correct amount of coins in a collector C. The coins may be of any combination of nickels, dimes, quarters, half-dollars and silver dollars. Conventionally, pennies are not accepted in toll booth apparatus and means are provided for passing any pennies that are deposited, without counting them. The coins travel from the collector C into and through the coin sorting and counting apparatus 10 comprising the present invention and then are automatically dropped into a safe S upon indication that the correct amount of coins has been deposited. When such an indication of correct coins is made, the automobile A moves off the treadle T and past a gate G which has been pivoted out of the way of the automobile A. Should the automobile attempt to pass the treadle T, either without depositing any coins or where incorrect amount of coins has been deposited, an alarm will sound if the gate G is not in place.

Figure 2:
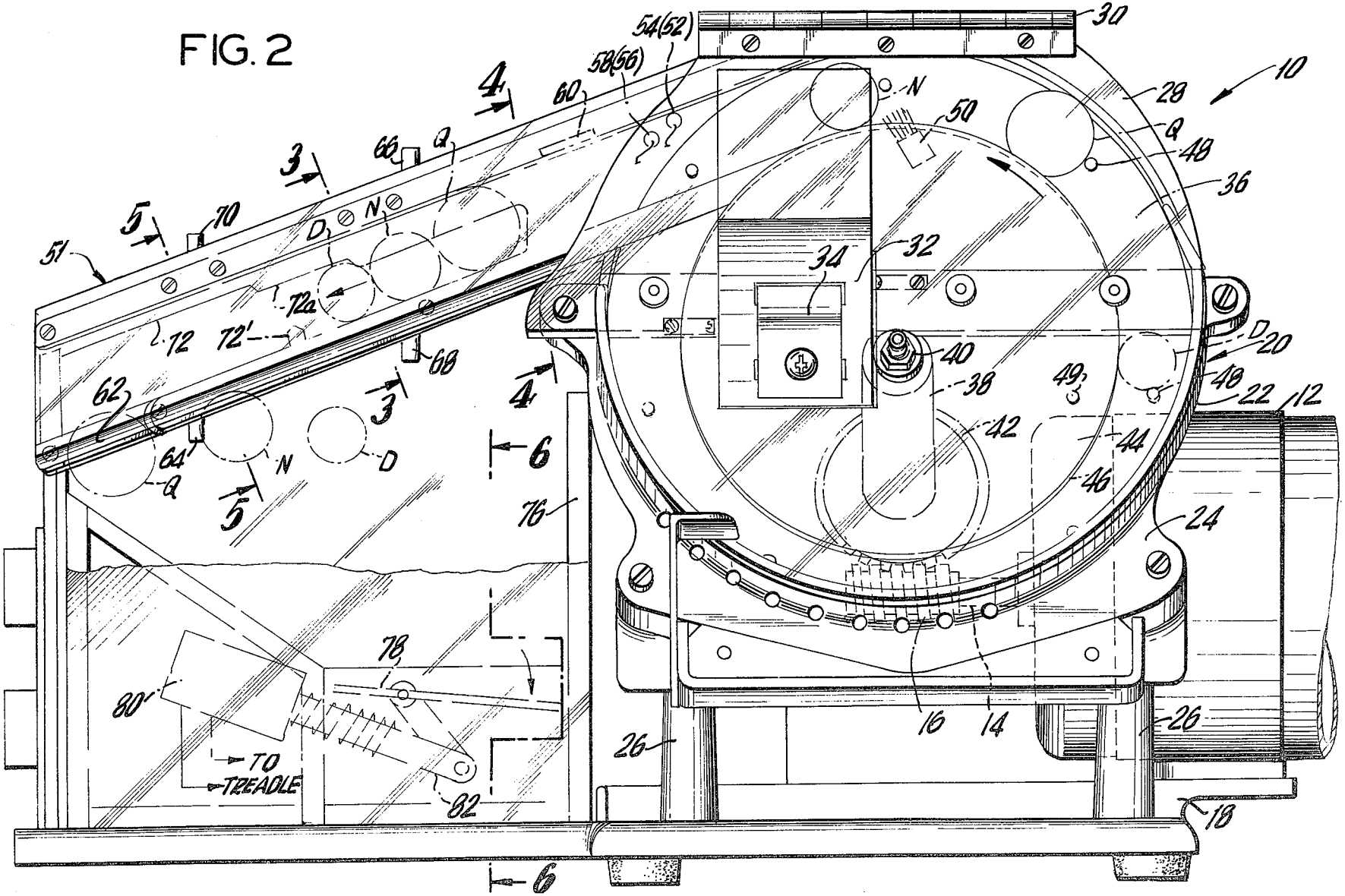
FIG. 2 is a front elevational view of one embodiment of the coin separating and counting apparatus comprising the present invention.
Figure 4:
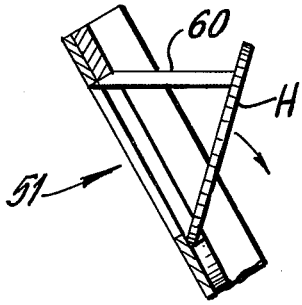
FIG. 4 is a fragmentary, sectional, elevational view taken along line 4—4 of FIG. 2.
Figure 5:
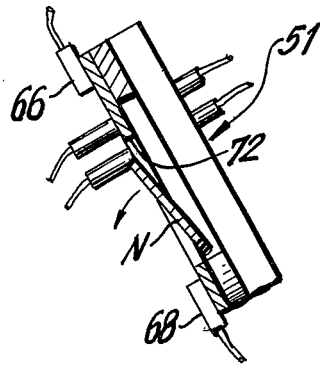
FIG. 5 is a fragmentary, sectional, elevational view taken along line 5—5 of FIG. 2.

The coin sorting and counting apparatus 10 comprising this invention may best be seen in FIGS. 2–6. Referring first to FIG. 2, it will be seen that the coin sorting and counting apparatus 10 comprising this invention includes a drive motor 12 having an output shaft 14 on which a worm gear 16 is rigidly secured. The motor 12 is suitably secured to a support bracket 18 on which is further mounted a housing 20.

The housing 20 is comprised of a side wall 22 having a generally circular shape in transverse cross-section and an integral flange 24 which is used for mounting the housing 20 on support posts 26. Conventional fasteners are used to secure the support posts 26 to the bracket 18. The front of the housing 20 is comprised of a cover plate 28 that is secured to the side wall 22 by means of a hinge 30. A chute 32 having a magnet 34 therein provides communication between the exterior coin collector C and the interior of the housing 20.

The rear wall 36 of the housing 20 slopes rearwardly and upwardly with respect to a vertical plane, and is rotatably supported by means of a shaft 38 that is secured thereto by a nut 40. The shaft 38 also supports a worm wheel 42 that is in meshing engagement with the worm gear 16 so that, as the output shaft 14 of the motor 12 rotates, the rear wall 36 is rotatably driven and thereby defines conveyor means. The rear wall 36 is also provided with a raised, disc-like central portion 44 that defines an annular undercut 46 at the periphery thereof. A first plurality of pins 48 are equally spaced on a common diameter intermediate the circumference of the disc-like portion 44 and the inside surface of the side wall 22. At least one other pin 49 is secured to the disc-like portion 44 at a position that is radially inward of the pins 48 for a purpose to be described hereinafter.

When the coins are deposited in the collector C, they fall through the chute 32 into the interior of the housing 20. The magnet 34 will attract any ferrous material that is deposited together with the coins. During rotation of the rear wall 36, the coins which normally fall to the bottom of the housing 20 as shown in FIG. 2 will be carried by the rear wall 36 in a counter-clockwise direction. The relatively smaller coins such as nickels, dimes and quarters will eventually lodge themselves in the undercut 46 and against one of the pins 48. This mode of operation is shown, for example in FIG. 2, by the ten cent piece D and the five cent piece N. The relatively larger coins such as the half-dollar and silver dollar will be picked up by a combination of the pin 49 and one of the pins 48. Flexible deflector means, for example a brush 50, is secured to the inside surface of the cover plate 28 and is positioned to intercept and deflect any coin that is not properly positioned on the pins 48 and 49.

As the coins reach the twelve o'clock position as shown in FIG. 2, they will enter a track assembly which is generally designated by the reference character 51. The lower, right hand edge of the track assembly 51 is tangent to the circumference of the disc-like member 44. The entrance to the track assembly 51 is at the highest point of the disc-like member 44 and is contiguous with the radial dimension between the undercut 46 to the inside surface of the wall 22. The track assembly 51 slopes downwardly to the left as shown in FIG. 2.

In the direction of travel downwardly along the track assembly 51 there is provided a first photoelectric cell 52 and a cooperating lamp 54 which are used to sense the passage of a half-dollar H. Immediately downstream thereof, there is a second photoelectric cell 56 and a lamp 58 associated therewith which are used for detecting the passage of a twenty-five cent piece Q. It should be noted at this time that a half-dollar H will cover both photoelectric cells 52 and 56 as well as their respective lamps 54 and 58 whereas a twenty-five cent piece will cover only the photoelectric cell 56 and its associated lamp 58.

Figure 3:
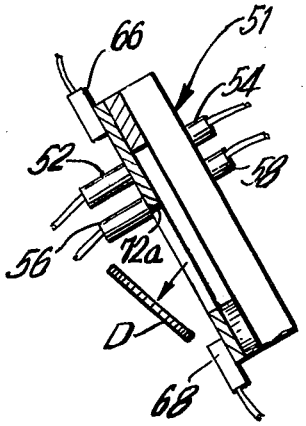
FIG. 3 is a fragmentary, sectional, elevational view taken along line 3—3 of FIG. 2.
Figure 6:
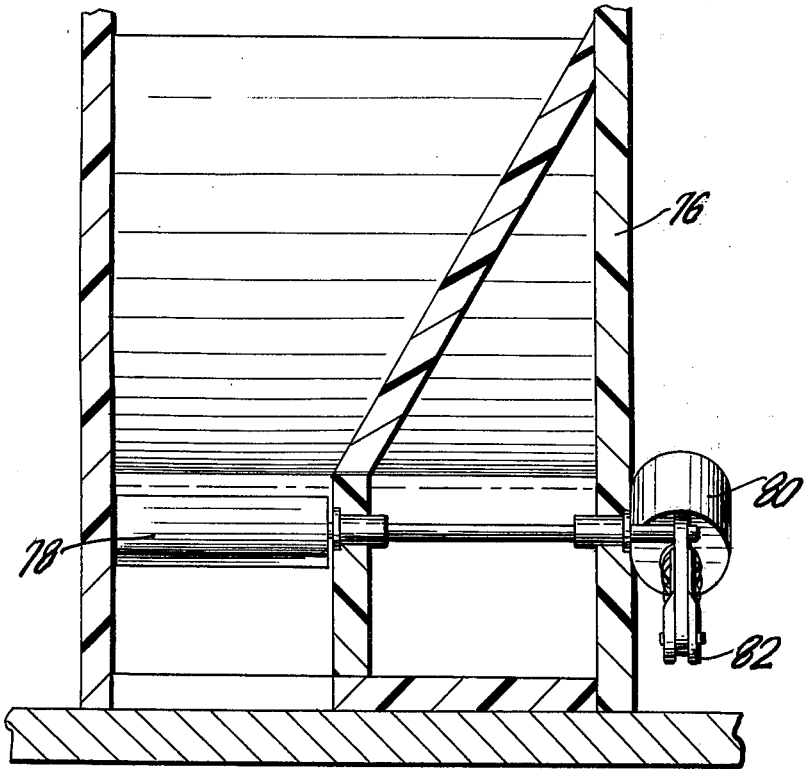
FIG. 6 is a fragmentary, sectional, elevational view taken along line 6—6 of FIG. 2.

After passing the photoelectric cell 52 and its associated lamp 54, the half-dollar H will strike a deflector 60 which is shown in FIG. 3 so that the coin will be ejected forwardly as viewed in FIG. 2 and to the right as shown in FIG. 3. Conversely, a twenty-five cent piece Q will bypass the deflector 60 and will travel down the length of the track assembly 51 until it is adjacent a slot 62 in the bottom surface thereof. The twenty-five cent piece Q will then fall through the end slot 62 in a downward direction as shown in FIG. 2. As shown in FIG. 2, the five and ten cent pieces N and D will also travel down the track assembly 51 past the third and fourth photoelectric cells 64 and 68 which have associated therewith lamps 66 and 70, respectively. As shown typically in FIG. 2 the nickels N and dimes D will fall rearwardly through openings 72 and 72*a*, respectively, which are formed in the track assembly 51.

A feature of this invention is that the nickels N and dimes D are detected by the photocells as they tumble past the photocells 64 and 68 interrupting the light beam from the lamps 66 and 70. It will be appreciated by a comparison of FIGS. 3, 4 and 5 that the axes of the light beams from the lamps 54 and 58 are perpendicular to the plane of the track assembly 51 and the path of the coins moving therealong while the axes of the light beams from the second pair of lamps 66 and 70 are parallel to the plane of the track assembly and the coins moving therealong. It will also be appreciated that while the presence of the quarters Q and the half-dollars H are sensed first near the entrance of the track assembly 51 the half-dollars are immediately shunted off by tapered member 60 while the quarters are discharged near the end thereof. Conversely the nickels N and dimes D are discharged closer to the entrance of the track assembly 51 and their presence is sensed after they are discharged therefrom.

After the coins leave the track assembly 51 they drop into a container 76, the bottom end of which is selectively closed by means of a butterfly valve 78. A solenoid 80 operates the butterfly valve 78 through a linkage system 82. The solenoid 80 is electrically coupled to the treadle T so that as the vehicle A crosses the treadle T the solenoid 80 is actuated.

Figure 7:
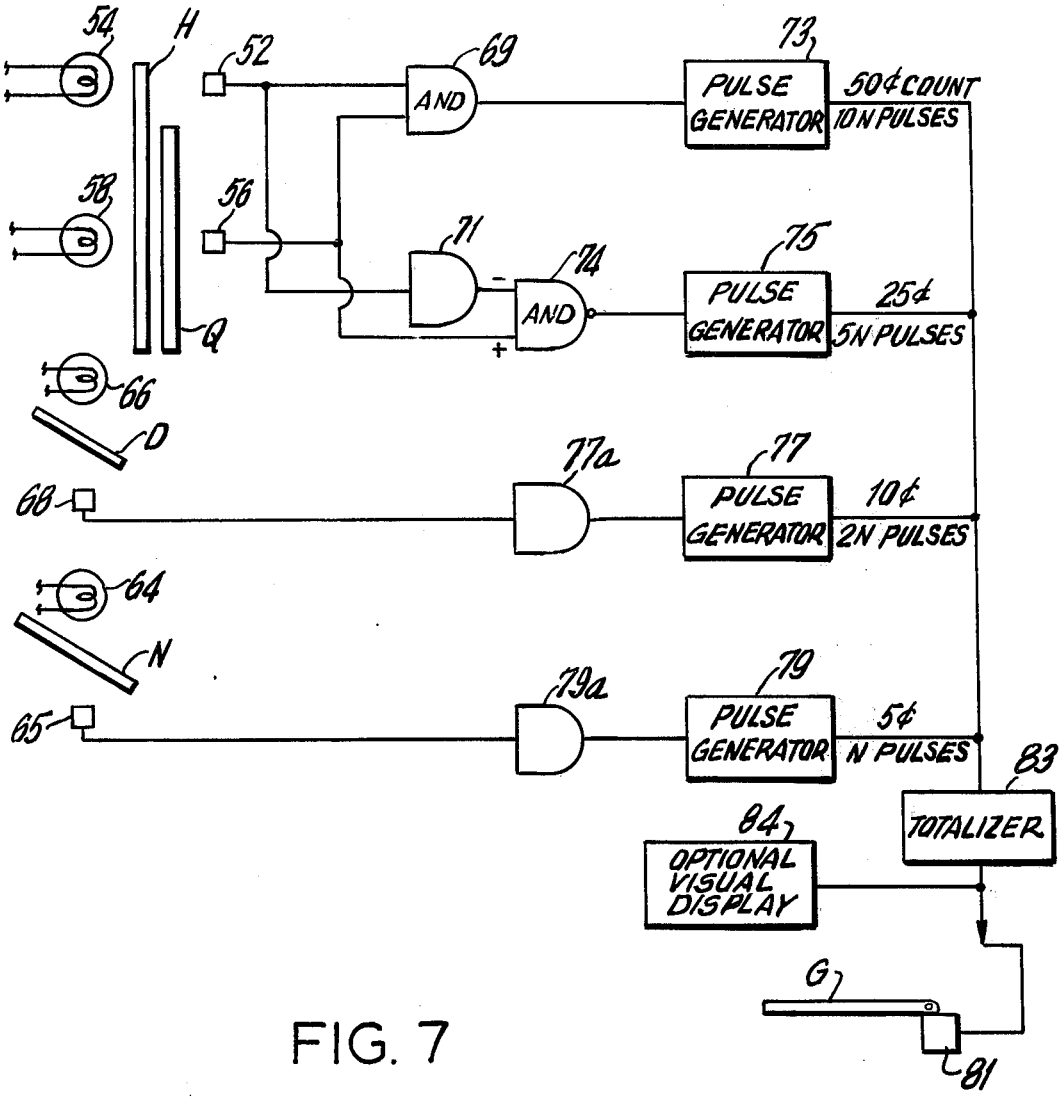
FIG. 7 is a schematic diagram illustrating one embodiment of circuitry that may be used in conjunction with the present invention.

Referring now to FIG. 7, as the fifty cent piece passes between lamp 54 and photocell 52 the lamp 58 and photocell 56, pulses are generated. If AND gate 69 receives the two pulses, a pulse generator 73 is gated on to release ten pulses, representing a fifty cent count to a totalizer 83. The pulse from the photocell 52 causes a gate 71 to generate a negative pulse to inhibit AND gate 74.

On the other hand a quarter Q will generate a pulse from photocell 56 and will turn on AND gate 74 in the absence of a signal from the photocell 52. The gate 74 will turn on a pulse generator 75 which will release a train of five pulses equivalent to twenty-five cents.

Likewise a coin tumbling past the light beam from the lamp 66 to photocell 68 will turn on a gate 77*a* which triggers a pulse generator 77 to release two pulses for a count of ten cents. A coin interrupting the light from the lamp 64 to the photocell 65 will gate on pulse generator 79 through a gate 79*a* to pass a single pulse to the totalizer 83.

When an appropriate number of counts are made by the totalizer 83 a signal is sent to an optional visual display 84 and/or the control means 81 actuating the barrier gate G.

For simplicity each pulse has been represented as a value of five cents. It will be understood however that a greater number of pulses can be employed to represent a particular numerical value by the use of an appropriate count down circuit.

Pennies drop out in opening 72*a*. While no provision has been shown in the drawing for counting of the pennies, it would be understood that a photocell and lamp may be provided to count them. In this case, each count would provide a pulse to the totalizer and the pulse generators 73, 75, 77 and 79 would be arranged to provide N equal to five pulses and the totalizer arranged to provide a corresponding total. Since pennies tend to fly a deflector 72' is provided extending behind the opening 72*a* to prevent pennies from passing in front of photocell 65.

There has been disclosed heretofore the best embodiment of the invention presently contemplated. However, it is to be understood that various changes and modifications may be made thereto without departing from the spirit of the invention.

What I claim as new and desire to secure by Letters Patent are:

1. A coin sorting and counting apparatus for a toll booth or the like, said apparatus comprising:

a. a housing including hopper means for receiving a plurality of coins of different denominations;

b. rotatable conveyor means in said housing for moving the coins along an arcuate path and in a single line;

c. means for driving said conveyor means;

d. an elongated track assembly for successively receiving the coins from said conveyor means and further including means for selectively discharging the coins at different locations depending upon the denomination of the coin;

e. sensing means comprising a plurality of pairs of photoelectric cells and associated lamps, there being one of said pairs of cells and lamps for each coin denomination, said pairs of sensing means being spaced along the length of said track assembly for detecting the denomination of the coins prior to the discharge thereof;

f. means responsive to said sensing means for generating a plurality of signals proportional to the denomination of each sensed coin and for totaling the said signals;

g. said first two pairs of sensing means being positioned such that a signal will be generated only when said first two of said pairs of sensing means simultaneously detect the passage of a half-dollar therepast in said track assembly and another signal will be generated indicating the presence of a quarter in said track assembly only when second one of said pairs of sensing means detects the passage of a quarter therepast; and h. means responsive to said total of said generated signals for indicating that the amount of the coins deposited is either correct or incorrect.

2. The apparatus according to claim 1 further including a container for receiving the coins after their discharge from said track assembly, said container including valve means responsive to said signal generating means for opening said container when the amount of coins deposited is correct whereby the coins may be directed to a remote location for safe keeping.

3. The apparatus according to claim 1 wherein said conveyor means comprises a base wall including an integral central disc having a groove around the perimeter thereof and a plurality of first pins extending away from said base wall, said first pins being angularly spaced apart on a common diameter that is radially outward of said groove whereby the edge of a coin is adapted to be positioned in said groove and concurrently in abutment with one of said first pins so that the coin may be moved along said arcuate path and into said track assembly.

4. The apparatus according to claim 3 wherein there is also included at least one second pin extending away from said base wall, said second pin being positioned radially inward of said groove so that a relatively large coin may be moved along said arcuate path thereby in combination with one of said first pins.

5. The apparatus according to claim 1 wherein there is further included flexible means for intercepting and displacing from said conveyor means any coin that is improperly placed prior to the time said improperly placed coin reaches said track assembly.

6. The apparatus according to claim 1 wherein said track assembly includes a plurality of discharge openings of different sizes corresponding to the diameters of a nickel, a dime, a quarter, a half-dollar and a silver dollar.

7. The apparatus according to claim 6 wherein said track assembly includes at least one deflecting means for guiding a coin into and through said discharge opening therefor.

8. The apparatus according to claim 7 wherein said deflecting means is positioned proximate said discharge opening for a half-dollar.

9. The apparatus according to claim 1 wherein said conveying means is a disc positioned at an angle with respect to a vertical plane and wherein said track assembly is angled downwardly with the inlet thereof being positioned proximate the maximum elevation of said disc whereby the coins move downwardly along said track assembly by gravity.

10. The apparatus according to claim 1 wherein said third and fourth pairs of sensing means are positioned such that a signal will be generated after coins of different denominations pass through the respective discharge means thereof.

* * * * *